US006755256B2

(12) United States Patent
Murley et al.

(10) Patent No.: US 6,755,256 B2
(45) Date of Patent: Jun. 29, 2004

(54) SYSTEM FOR CEMENTING A LINER OF A SUBTERRANEAN WELL

(75) Inventors: Ian Murley, Pearland, TX (US); Jean-Marc Follini, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 10/043,003

(22) Filed: Jan. 9, 2002

(65) Prior Publication Data

US 2002/0104656 A1 Aug. 8, 2002

Related U.S. Application Data

(60) Provisional application No. 60/262,746, filed on Jan. 19, 2001.

(51) Int. Cl.[7] ..... E21B 33/13; E21B 43/00

(52) U.S. Cl. ..... 166/381; 166/285; 166/313; 166/177.4

(58) Field of Search ..... 166/285, 313, 166/378, 380, 381, 50, 177.3, 177.4, 277

(56) References Cited

U.S. PATENT DOCUMENTS

| | | | | |
|---|---|---|---|---|
| 1,718,416 A | | 6/1929 | Granger | |
| 2,876,844 A | | 3/1959 | Warner | |
| 3,635,288 A | * | 1/1972 | Lebourg | 166/156 |
| 3,951,208 A | * | 4/1976 | Delano | 166/78.1 |
| 4,842,069 A | | 6/1989 | Baugh et al. | |
| 5,052,488 A | * | 10/1991 | Fraser, III | 166/285 |
| 5,520,252 A | * | 5/1996 | McNair | 166/313 |
| 5,526,880 A | * | 6/1996 | Jordan et al. | 166/291 |
| 5,829,526 A | * | 11/1998 | Rogers et al. | 166/291 |
| 5,890,537 A | * | 4/1999 | Lavaure et al. | 166/285 |
| 5,944,107 A | * | 8/1999 | Ohmer | 166/313 |
| 5,944,108 A | | 8/1999 | Baugh et al. | |
| 6,009,944 A | | 1/2000 | Gudmestad | |
| 6,079,495 A | * | 6/2000 | Ohmer | 166/313 |
| 6,138,761 A | * | 10/2000 | Freeman et al. | 166/313 |
| 6,209,648 B1 | * | 4/2001 | Ohmer et al. | 166/313 |
| 6,253,852 B1 | * | 7/2001 | Nobileau | 166/313 |
| 6,267,181 B1 | * | 7/2001 | Rhein-Knudsen et al. | 166/332.4 |
| 6,311,775 B1 | * | 11/2001 | Allamon et al. | 166/285 |
| 2002/0000318 A1 | * | 1/2002 | Allamon et al. | 166/291 |

FOREIGN PATENT DOCUMENTS

GB 2300013 A 10/1996

* cited by examiner

*Primary Examiner*—David Bagnell
*Assistant Examiner*—Jennifer H Gay
(74) *Attorney, Agent, or Firm*—Trop, Pruner & Hu, P.C.; Jeffrey Griffin; Brigitte Jeffery Echols

(57) ABSTRACT

An apparatus that is usable with a subterranean well includes a liner and a wiper. The liner is to be cemented inside the well bore, and the wiper, in a first mode, is connected to the liner when the liner is run downhole. In a second mode, the wiper is released to respond to a cement flow.

16 Claims, 8 Drawing Sheets

SYSTEM FOR CEMENTING A LINER OF A SUBTERRANEAN WELL

Pursuant to 35 U.S.C. § 119, this application claims the benefit of U.S. Provisional Application Serial No. 60/262,746, entitled "SYSTEM FOR CEMENTING A LINER OF A SUBTERRANEAN WELL," filed on Jan. 19, 2001.

BACKGROUND

The invention generally relates to a system for cementing a liner of a subterranean well.

Liners are commonly used in subterranean wells. As the name implies, a liner lines a section of a well bore. Such liners typically "hang" from a parent casing and may be cemented in place to the casing to provide structural support to the well bore.

In a typical liner cementing application, the liner is first hung on the parent casing, and the cementing tool is thereafter lowered to the liner. Cement is then pumped through the cementing tool to the area between the liner and the well bore. To force the cement down into the particular space being cemented, a displacement fluid, such as water (for example), may be used. In this manner, at the surface of the well, a device called a dart may be placed between the displacement fluid and the cement to form a barrier to prevent mixing of the cement and the displacement fluid. The dart follows the displacement fluid/cement interface downhole as more displacement fluid is introduced from the surface of the well to push the cement into the region to be cemented.

When the dart approaches the bottom of the cementing tool, the dart may engage a wiper that is part of and located at the bottom of the cementing tool. The dart seals a central passageway of the wiper through which the cement passes and dislodges the wiper from the cementing tool, thereby forming a barrier that wipes cement from the interior surface of the liner.

Unfortunately, the conventional wiper for use in liner applications typically is located at the bottom of the cementing tool and thus, is contacted by surfaces of varying diameters as the cementing tool is lowered downhole. As a result, depending on the geometry of the well bore and well bore completion, the wiper may be broken off or damaged as the cementing tool is being run downhole.

Conventional wiper darts are also not adapted to efficiently seal on a wide range of tubing diameters. For instance, conventional wiper darts may not be adequate to efficiently seal on larger diameter tubing (such as 4") as well as smaller diameter tubing (such as 1.75"). Many completions currently include such a range of tubing diameters.

In addition, conventional systems often leave plug-mounting hardware in place that reduces the liner drift diameter and may prevent the performance of subsequent operations, such as cement evaluation. Retrieval of such plug mounting hardware is often required prior to the performance of the subsequent operations.

Moreover, in some instances as shown in the case of FIG. 1, the typical liner cementing application would provide undesirable consequences. FIG. 1 shows a casing 6 of a multilateral well. The casing 6 may include a junction 5, a part of the casing 6 in which a main vertical well bore 7*a* transitions into lateral well bores, such as lateral well bores 7*b* and 7*c* that are depicted in FIG. 1. Before the lateral well bores 7*b* and 7*c* are drilled, the main well bore 7*a* is drilled, and the junction 5 is cemented in place. To accomplish this, a cementing tool (not shown) may be lowered downhole to deliver cement into the region of the well bore 7*a* that surrounds the junction 5.

After the junction 5 is cemented in place, the lateral well bores 7*b* and 7*c* are drilled. After each lateral well bore 7*b*, 7*c* is drilled, a liner 8 is hung from one of the legs of the junction 5 by a liner hanger 3. After the liner 8 is hung, the liner 8 is then cemented in place.

To cement the liner in place, a cementing tool is typically deployed to the liner 8, and cement is pumped into the area between the liner 8 and the well bore. As the cement fills up such area, the cement displaces a fluid which must find a return path uphole of the liner hanger 3. To enable such return path, an operator either runs the liner cementing operation with the packer 2 unset, or installs a through port collar on the liner top. In either case, the return path enables displaced fluid, cement, or other debris to pass into the interior of the junction 5, which is undesirable for a variety of reasons. One of these reasons is that it may be necessary to mill out such displaced fluid, cement, or other debris from the junction after the end of the cementing operation, which milling operation may harm the structural integrity of the junction.

Thus, there is a continuing need for an arrangement and/or technique that addresses one or more of the problems that are stated above.

SUMMARY

In an embodiment of the invention, an apparatus that is usable with a subterranean well includes a liner and a wiper. The liner is to be cemented inside the well bore, and the wiper, in a first mode, is connected to the liner when the liner is run downhole. In a second mode, the wiper is released from its connection to the liner to respond to a cement flow.

Advantages and other features of the invention will become apparent from the following drawings, specification and claims.

DETAILED DESCRIPTION

Figure 1:
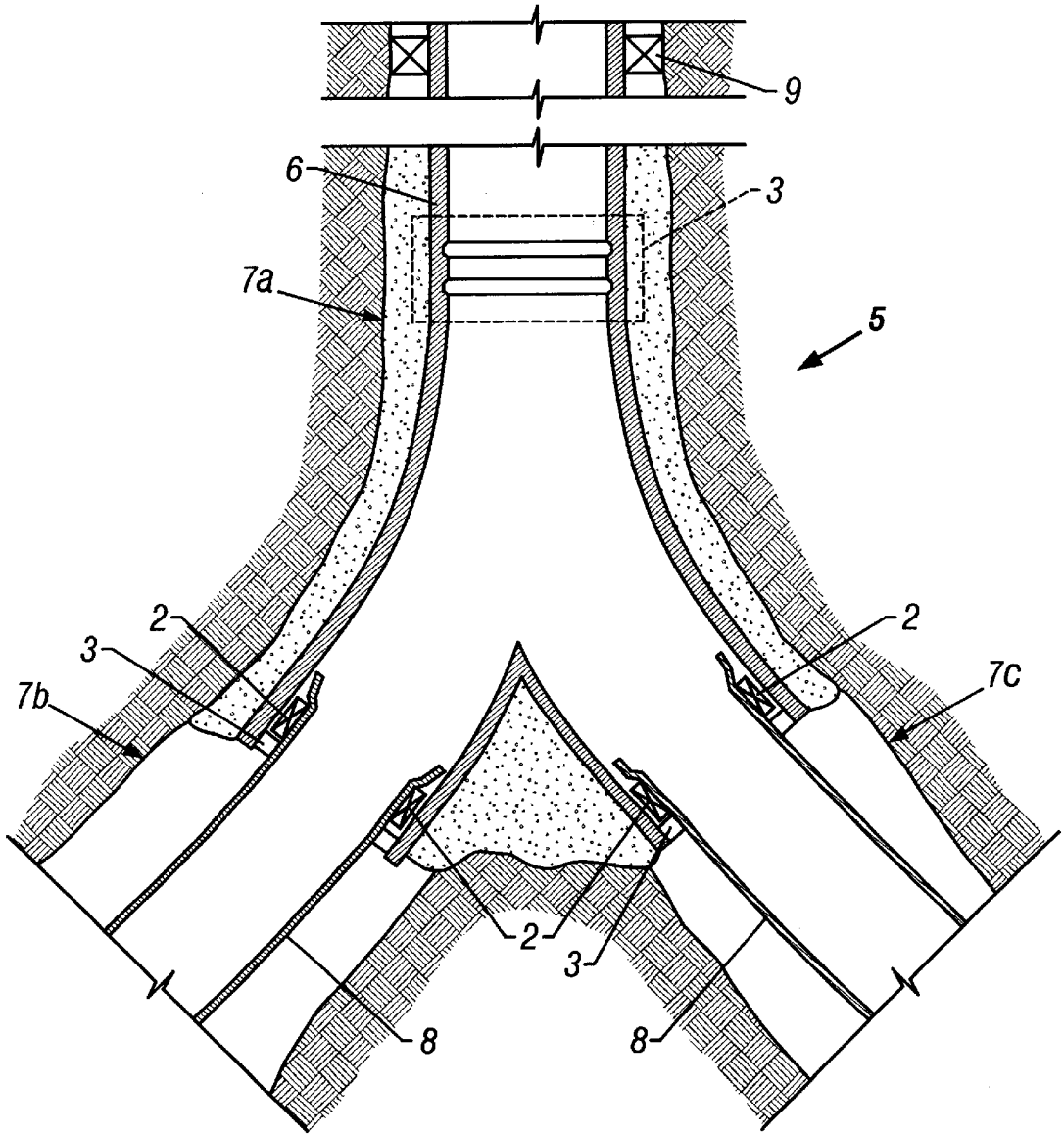
FIG. 1 (Prior Art)
FIG. 1 is a schematic diagram of a junction of a multilateral well of the prior art.
Figure 2:
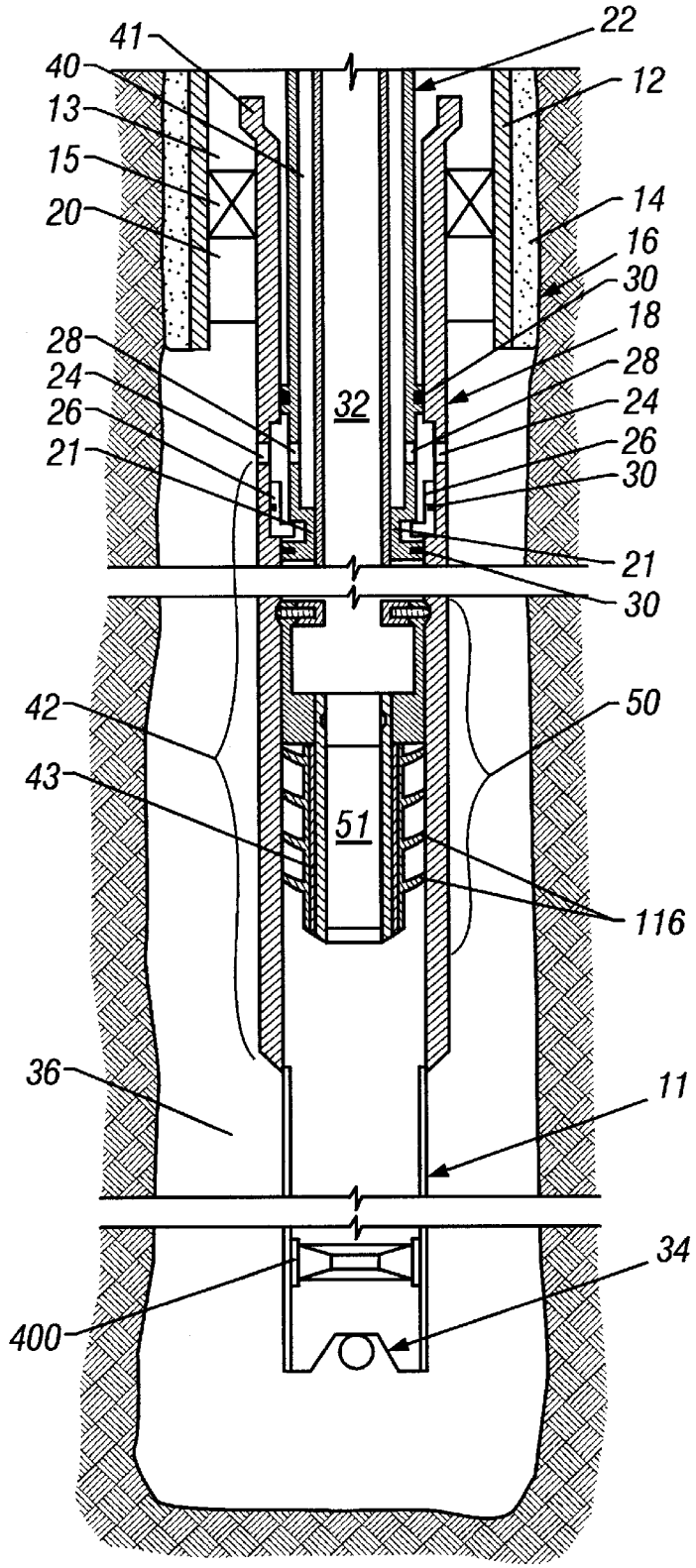
FIGS. 2 and 10 are schematic diagrams of systems to cement a liner of a multilateral well according to different embodiments of the invention.
Figure 11:
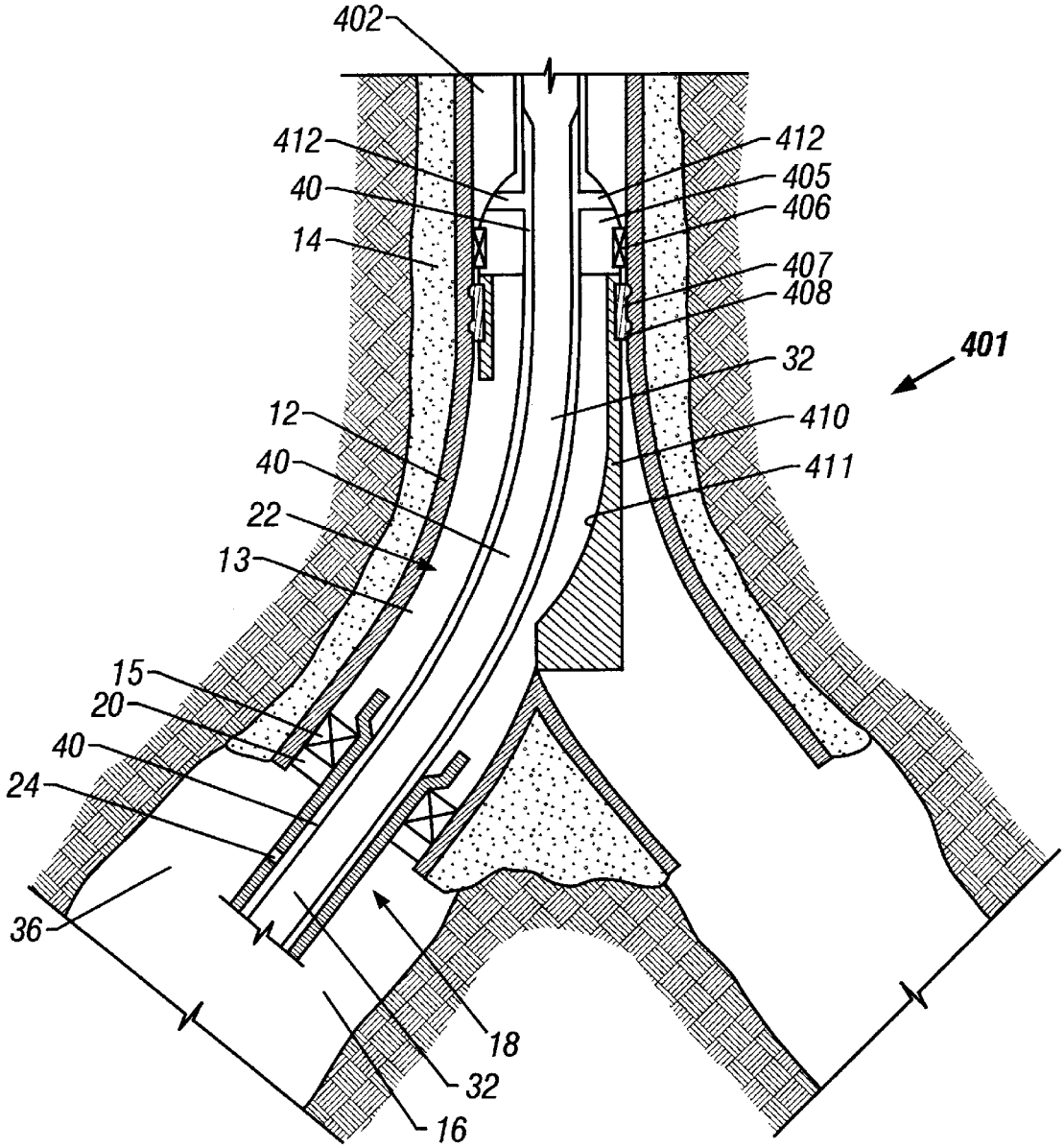
FIG. 11 is a schematic diagram of a junction of a multilateral well, including a liner that is cemented according to one embodiment of the invention.

Referring to FIG. 2, an embodiment 10 of a system for use in a subterranean well includes a liner top or liner string 18 that is run downhole to both hang a liner 11 in a lateral well bore 16 and aid in cementing the liner 11 in place, as described below. In this manner, the liner top 18 includes both a hanger 20 (dogs or slips, for example) that secures the liner top 18 to a casing 12 and a packer 15 that seals the liner top 18 to the casing 12. During a cementing operation to cement the liner 11 in place, the seal that is provided by the packer 15 prevents cement from the cementing operation (described below) from contaminating a region 13 of the parent casing 12 above the packer 15. In this manner and as shown in FIG. 11, near the lateral well bore 16, the casing 12 may include a junction 401, for example, that forms the transition between the lateral well bore 16 and a main well bore 402. As an example, the region 13 to be isolated from the cement may include the interior of this junction, as the junction may include interior profiles that are used to guide tools that are lowered downhole after the liner 11 has been cemented in place.

Before the lateral well bore 16 is drilled to accept the liner top 18, the parent casing 12 is cemented in place. After the lateral bore 16 is drilled to accept the liner top 18, the liner top 18 is run downhole and cemented using a cementing tool 22 and features of the liner top 18, described below.

Figure 3:
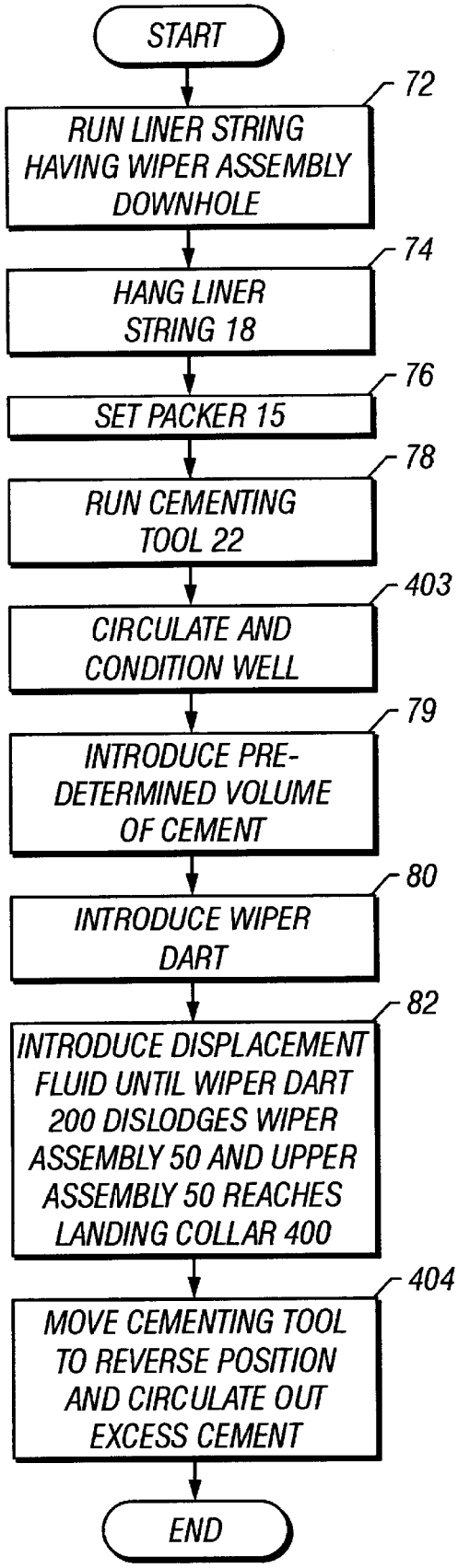
FIG. 3 is a flow diagram depicting a technique to cement the liner using the system of FIG. 2 according to an embodiment of the invention.

More specifically, referring also to FIG. 3, in some embodiments of the invention, a technique 70 may be used to install the liner top 18 downhole. As noted above, the first part of this technique includes running (block 72) the liner top 18 downhole, hanging the liner top 18 (block 74) to the parent casing 12 and setting (block 76) the packer 15. This part of the technique may be performed in numerous different ways. For instance, blocks 74 and 76 may be performed concurrently if the same downhole tool performs both functions. However, unlike conventional techniques and conventional liner tops 18, the liner top 18 includes a wiper assembly 50 that, in a first mode of operation, is located inside the liner top 18 and thus, is run downhole with the liner top 18. The use of the wiper assembly 50 is described further below.

After the packer 15 is set and the liner top 18 is hung from the casing 12, a cementing tool 22 is run (block 78) downhole and received into the central passageway 41 of the liner top 18 to engage the string 18. At this point, the well is circulated and conditioned (block 403). The cementing tool 22 is used to introduce (block 79) a predetermined volume of cement into a well bore region 36 that exists between the liner top 18 and the wall of the lateral well bore 16. In this manner, the cement is communicated downhole from the surface of the well through the central passageway of a drill string that, in turn, communicates the cement to a central passageway 32 of the cementing tool 22. After the predetermined volume of cement is introduced into the drill string, a wiper dart 200 (see FIG. 9), further described below, is introduced (block 82) into the central passageway of the drill string. Once the cementing operation is complete, the cementing tool 22 is moved to the reverse position and the excess cement is circulated out (block 404).

Referring to FIG. 2, the wiper dart 200 forms a barrier between the incoming cement and a displacement fluid (water, for example) that is introduced above the wiper dart 200 in the drill string. In this manner, three different fluids may exist in the drill string/cementing tool 22 during the initial stages of the cementing operation: a lower fluid (mud, for example) that is located in the region 36 to be cemented and in the lower end of the drill string/cementing tool 22; the cement that is located above the lower fluid in the drill string/cementing tool 22; and the displacement fluid that is located above the cement. As more displacement fluid is introduced, the displacement fluid/cement interface (and the wiper dart 200 at this interface) and the cement/lower fluid interface move downhole.

To circulate the lower fluid out of the region 36 to permit the cement to enter the region 36, a return path to the surface is created. This return path includes the region 36, radial ports 24 (of the liner top 18) that are in communication with the region 36, ports 28 formed on the cementing tool 22, and an annular region 40 in the interior of the cementing tool 22. In one embodiment, the central well bore 32 forms the inner boundary of the annular region 40. In some embodiments of the invention, the annular region 40 of the cementing tool 22 may be in communication with a central passageway of the parent casing 12 above the isolated region 13.

To establish communication between the region 36 outside of the liner top 18 and the region 40 inside the cementing tool 22, the liner top 18 includes radial ports 24 that are initially covered by an inner sleeve 26. As the cementing tool 22 is run in, a profile 21 on the cementing tool 22 engages the inner sleeve 26 causing it to slide downwardly thereby uncovering the radial ports 24 and allowing fluid communication between the radial ports 24 and the tool ports 28. The tool ports 28, in turn, provide fluid communication to the annular region 40. In one embodiment, the profile 21 remains latched to the open inner sleeve 26. In another embodiment, the profile 21 and the inner sleeve 26 are designed so that the profile 21 detaches from the inner sleeve 26 after the inner sleeve 26 opens. In either case, once the cementing operation is completed and the cementing tool 22 is picked up, the profile 21 can be adapted to once again selectively engage the inner sleeve 26 causing it to slide upwardly thereby covering the radial ports 24. Seals 30 on the cementing tool 22 and inner sleeve 26 provide a sealing communication for the return fluid as it flows from the well bore region 36 to the tool annular region 40.

The liner top 18 further includes a polished bore receptacle 42 that has a central passageway that is coaxial with the central passageway 32 (of the cementing tool 22). The polished bore 42 extends to the liner 11.

As more displacement fluid is introduced at the surface, the displacement fluid forces the cement to flow through a check valve 34 (located at the bottom of the liner 11) into the region 36 and thus, displaces lower fluid from the region 36 by forcing the lower fluid to return via the annular region 40 of the cementing tool 22. The wiper dart 200 (and the displacement fluid/cement interface) eventually enters the central passageway 32 of the cementing tool 22.

As described below, the wiper dart 200 is constructed to engage a wiper assembly 50 that is mounted inside the liner top 18. More specifically, the wiper assembly 50 includes a central passageway 51 that is coaxial with the central passageways of the cementing tool and seal bore 42 and permits the cement to flow through the wiper assembly 50. When the wiper dart 200 reaches the wiper assembly 50, the wiper dart 200 plugs the central passageway 51 and disengages (as described in more detail below) the wiper assembly 50 from the liner top 18 to place the wiper assembly 50 in a second mode of operation. Thus, from this point on, the combination of the wiper dart 200 and wiper assembly 50 form the barrier between the displacement fluid and the cement.

As depicted in FIG. 2, the wiper assembly 50 includes fins 116 that swab the interior surface of the liner 11 to clean cement from the interior surface as the disengaged wiper assembly 50 travels down through the liner 11. Eventually the wiper assembly 50 reaches its bottom point of travel as the wiper assembly 50 reaches a landing collar 400 and stops. The landing collar 400 is attached to the liner 11 and may include an anti-rotation mechanism (such as tabs or grooves) that cooperates with a similar mechanism on the wiper assembly 50 to prevent the relative rotation of the two when the wiper assembly 50 is landed on the landing collar 400. At this point, the desired volume of cement has been pushed into the annular region 36, and this event may be detected at the surface of the well due to a significant increase in the pressure of the displacement fluid, as flow of the fluid is halted.

FIG. 11 schematically shows the cementing tool 22 described herein cementing a liner and liner top 18 in a leg of multilateral junction 401. The junction 401, proximate the main well bore 402, includes a profile 408 that mates with the latching element 407 of a deflector 410. The deflector 410 and junction 401 may further include an orienting mechanism to correctly orient the deflecting surface 411 of the deflector 410 towards the relevant liner top 18 and lateral well bore 16. The deflector 410 and junction 401 may also include a locking mechanism that prevents the longitudinal movement of the deflector 410 within the junction 401. The cementing tool 22 is run in hole and is guided by the deflecting surface 411 towards the liner top 18, as previously discussed.

The cementing tool 22 includes a tool head 405. In one embodiment (shown in the Figures), the tool head 405 sits on the upper surface of the deflector 410. In another embodiment (not shown), the tool head 405 is located a distance above the deflector 410 and is supported in that position by the work string that suspends it and by a shoulder on the cementing tool exterior that sits on the liner assembly, such as on the liner packer or hanger. In yet another embodiment (not shown), the tool head 405 includes locking keys that engage another profile located on the junction 401 or on the casing above the junction 401. In any of these embodiment, the tool head 405 includes at least one sealing element 406 that is activated to provide a seal between the tool head 405 and the junction 401 or casing.

Fluid from the well bore annular region 36 being returned within the annular region 40 of the cementing tool 22 flows within the annular region 40 until it reaches the tool head 405. At the tool head 405, the fluid is diverted through bypass ports 412 to the exterior of the cementing tool 22. The bypass ports 412 are located above the sealing elements 406; therefore, the fluid flowing therethrough does not and may not pass into the interior region 13 of the junction 401.

The interior region 13 is thus located between the sealing elements 406, which seal the tool head 405 to the junction 401 or casing, and the packers 15, which seal the liner top 18 to the junction 401. And, since the cementing tool 22 ensures that the return fluid is located internally of the cementing tool 22 (within the annular region 40) as it passes through the interior region 13, the cementing tool 22 and the system described herein ensure that the fluid displaced from the well bore annular region 36 does not invade the interior region 13. The interior region 13 is therefore isolated from the cementing operation. As previously discussed, it is preferable to maintain the interior region 13 of the junction 5 free of such fluids, cement, and other debris.

Figure 9:
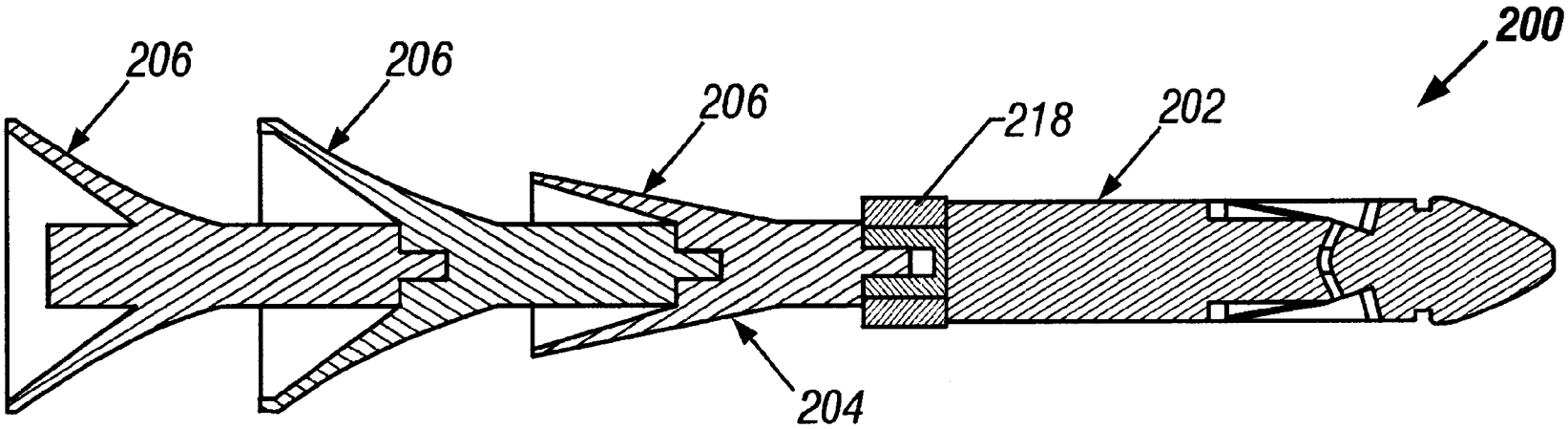
FIG. 9 is a schematic diagram of the wiper dart according to an embodiment of the invention.

Referring to FIG. 9, in some embodiments of the invention, the wiper dart 200 includes a bullnose section 202 that has a streamlined profile suitable for stabbing the wiper assembly 50, as described below. The wiper dart 200 also includes a tail section 204 that includes wiper fins 206. The fins 206 may have various sizes to form seals and/or barriers in the various inner diameters that are encountered by the wiper dart 200 in its downward travel.

FIGS. 4, 5, 6, 7 and 8 depict, in more detail, the engagement of the wiper dart 200 with the wiper assembly 50 and the resulting disengagement of the wiper assembly 50 from the liner top 18. In these figures, only the bullnose section 202 of the wiper dart 200 is depicted for purposes of clarifying the discussion. It is noted, however, that in operation the wiper dart 200 includes the tail section 204.

Figure 4:
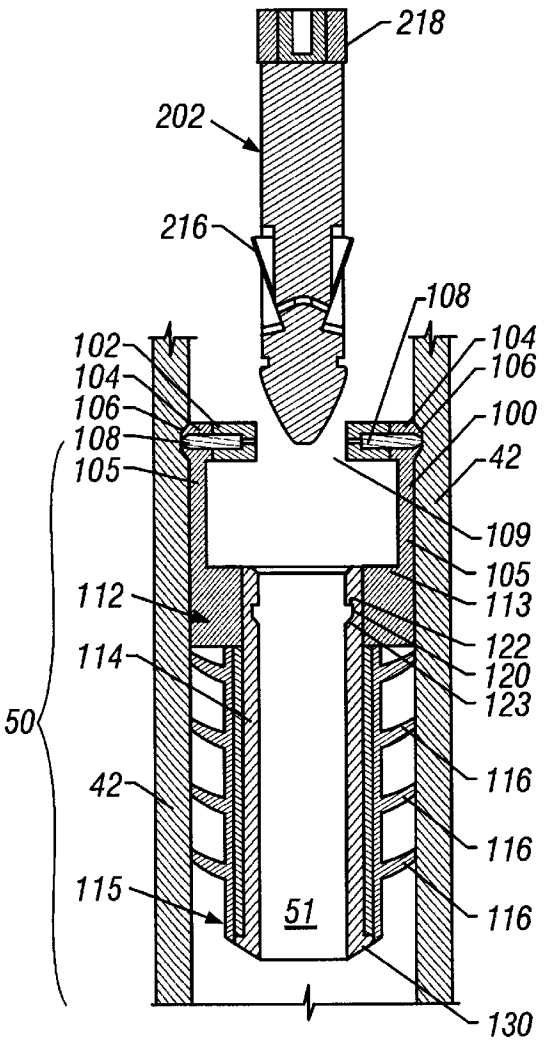
FIGS. 4, 5, 6, 7 and 8 are illustrations depicting operation of a wiper dart and wiper assembly of the system of FIG. 2 according to an embodiment of the invention.

Referring to FIG. 4, when the wiper dart 200 approaches the wiper assembly 50, the bullnose section 202 of the dart 200 enters an opening 109 of a knockout ring 102, a ring that is coaxial with the central passageway 51 and is sized to allow all but a trailing upset ring 218 of the bullnose section 202 to pass through. The knockout ring 102 is held in place by shear pins 108, each of which radially extends away from the ring 102 into an end 104 of a different collet finger 105. In this manner, the collet fingers 105 are part of a collet sleeve 112 that is coaxial with the central passageway 51. The collet fingers 105 extend from an annular base 113 of the collet sleeve 112 to their respective ends 104. Due to the resiliency of the collet fingers 105, the fingers 105 have a tendency to inwardly collapse in a direction toward the axis of the collet sleeve 112. However, the knockout ring 102 forces the ends 104 of the collet fingers 105 into an annular groove 106 that has a beveled cross section. When the collet fingers 105 are forced into the groove 106, the position of the collet sleeve 112 is locked into place.

As depicted in FIG. 4, the annular base 113 of the collet sleeve 112 holds the upper end of a generally cylindrical mandrel 114 that extends downhole from the annular base 113. The mandrel 114 is coaxial with the central passageway 51. As an example, an interior surface (of the annular base 113) that contacts the upper exterior surface of the mandrel 114 may include teeth that mate with respective grooves of the mandrel 114 to secure the mandrel 114 to the collet sleeve 112. The mandrel 114 provides support for a resilient wiper 115 that circumscribes the mandrel 114 below the annular base 113 of the collet sleeve 112. The wiper 115 includes fins 116 that circumscribe the axis of the mandrel 114 and serve to both form a barrier between the cement and the displacement fluid and wipe cement from the interior of the liner 11.

Figure 5:
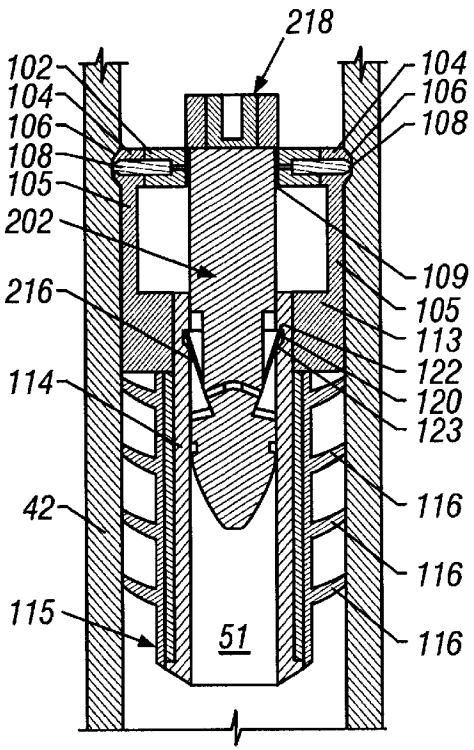

Referring to FIG. 5, as noted above, the opening 109 of the knockout ring 102 is not sized to permit the upset ring 218 to pass through. As a result, the knockout ring 102 catches the wiper dart 200. In this position of the wiper dart 200, leaf springs 216 of the bullnose section 202 extend outwardly into an annular notch 120 that is formed in the mandrel 114. The notch 120 includes an upper shoulder 122 that is perpendicular to the axis of the central passageway 51, an orientation that prevents the leaf springs 216 from leaving the notch 120 should pressure downhole tend to force the wiper dart 200 uphole. Thus, the notch 120 and leaf springs 122 provide a ratchet mechanism to prevent the wiper dart 200 from moving back uphole. A lower shoulder 123 of the notch 120 is beveled to not impose a restriction to downward travel of the wiper dart 200 with respect to the mandrel 114, as described below.

Figure 6:
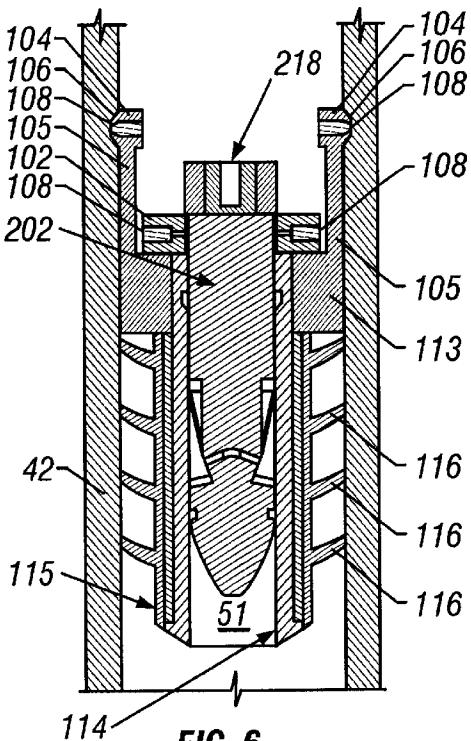

Referring to FIG. 6, when sufficient pressure is applied to the displacement fluid at the surface of the well, this pressure produces a force (due to the engagement of the wiper dart 200 with the knockout ring 109) on the wiper dart 200 to cause the shear pins 108 to shear. As noted above, the leaf springs 122 do not restrict downward travel of the wiper dart 200. Therefore, the wiper dart 200 and the engaged knockout ring 109 travel in a downward direction until the knockout ring 109 rests on the annular base 113 (of the collet sleeve 112), as the opening in the annular base 113 is sized to prevent the knockout ring 109 from passing through.

Figure 7:
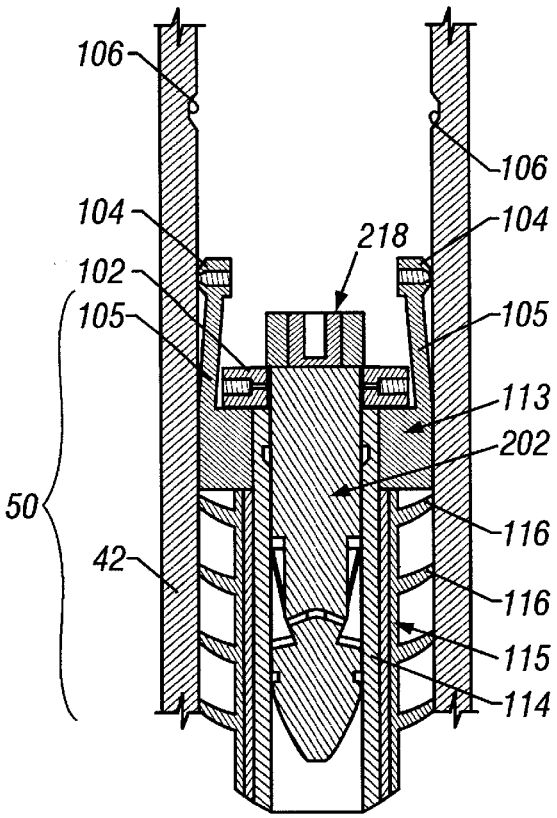
Figure 8:
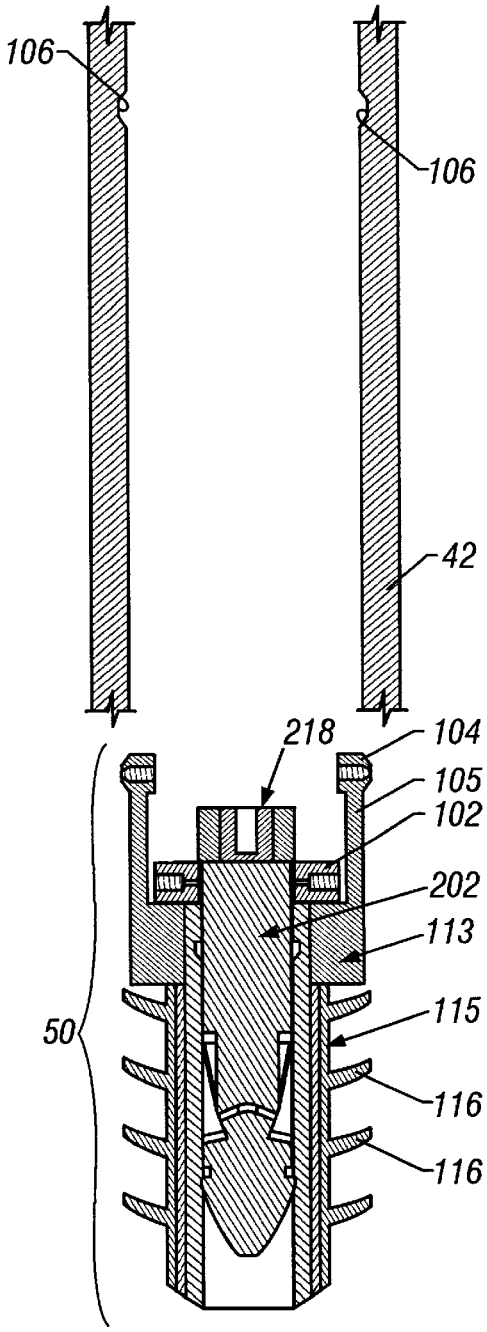

Referring to FIG. 7, the removal of the knockout ring 109 between the ends 104 of the collet fingers 105 permits the ends 104 to collapse toward the axis of the collet sleeve 112, thereby allowing the ends 104 to slip out of the groove 106. As a result, the collet sleeve 112, knockout ring 109, mandrel 114, wiper 115 and wiper dart 200 move as one assembly down the sealbore 42, leaving the sealbore 42 free from any obstructions due to the wiper assembly 50, as depicted in FIG. 8. Leaving the sealbore 42 and the liner unobstructed is important for the performance of subsequent operations, such as evaluation of the cementing job. With the sealbore 42 and liner unobstructed, such subsequent operations may be performed without having to retrieve any hardware left behind during the cementing operation.

Figure 10:
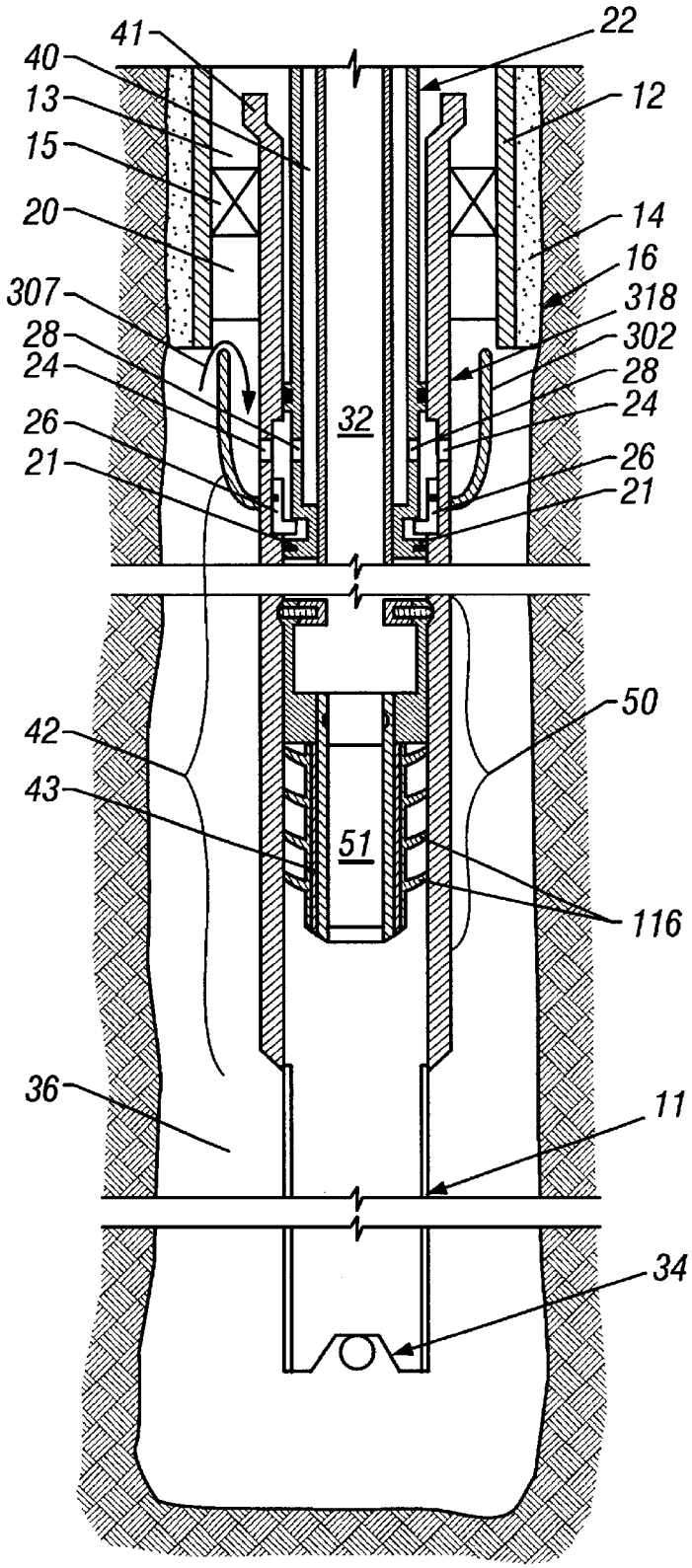

The positions of the radial ports 24 generally define the height of the concrete within the region 36. It is desirable for the height of this cement to reach the bottom level of the cement that surrounds the parent casing 12. However, it may be difficult to raise the heights of the ports 24 due to the geometries involved, and as a result a gap may exist between the top of the cement that surrounds the liner top 18 and the bottom of the cement that surrounds the casing 12. An alternative liner top 318 that is depicted in FIG. 10 may be used to raise the height of the cement in the region 36 to decrease the span of the gap or eliminate the gap altogether.

The liner top 318 has a similar design to the liner top 18 except for the following features. In particular, unlike the liner top 18, the liner top 318 includes an extension sleeve 302 that circumscribes the outer housing of the liner top 318 to force the cement upward above the ports 24 to at least partially fill the otherwise present gap. The sleeve 302 has a cup-like design in that the bottom of the sleeve 302 is attached to the outer housing of the liner top 18 just below the ports 24. The sleeve 302 extends in an upward and in a slightly radially outward direction to extend above the ports 24. The top of the sleeve 302 is not attached to the outer housing of the liner top 18. Therefore, due to this design, a circulation flow is established as depicted by the exemplary circulation path 307. In this flow, the cement flows in an upward direction between the exterior surface of the extension sleeve 302 and the lateral well bore 16. Once the cement reaches the top of the extension sleeve 302 (which is near or above the lower end of the casing 12), the cement flows in a downward direction between the interior surface of the extension sleeve 302 and the exterior surface of the outer housing until the cement reaches the radial ports 24 in the liner top 18. Other embodiments of the extension sleeve 302 are possible.

In the preceding description, directional terms, such as "upper," "lower," "vertical," "horizontal," etc., may have been used for reasons of convenience to describe the liner top and its associated components. However, such orientations are not needed to practice the invention, and thus, other orientations are possible in other embodiments of the invention.

While the invention has been disclosed with respect to a limited number of embodiments, those skilled in the art, having the benefit of this disclosure, will appreciate numerous modifications and variations therefrom. It is intended that the appended claims cover all such modifications and variations as fall within the true spirit and scope of the invention.

What is claimed is:

1. An apparatus comprising:

a tubular member including a port to circulate cement from a region outside of the member into a region inside of the member, and a sleeve attached to the exterior of the tubular member and located in the region outside of the tubular member to alter a flow of the cement near the part in response to the cement circulating through the port.

2. The apparatus of claim 1, wherein the sleeve at least partially circumscribes the tubular member.

3. The apparatus of claim 1, wherein the sleeve extends the flow of the cement beyond the port.

4. The apparatus of claim 1, wherein the sleeve comprises a first end that is attached to the exterior of the tubular member and a second opposite end that is not attached to the exterior of tubular member.

5. The apparatus of claim 1, wherein the sleeve, in response to the cement circulating through the port, causes the flaw to extend into a region in which the flow would not enter in the absence of the sleeve.

6. The apparatus of claim 5, wherein said region in which the flow would not enter in the absence of the sleeve comprises a region located above the port.

7. The apparatus of claim 1, wherein the sleeve creates a radial barrier outside of the port in response to the cement circulating from the region outside of the tubular member through the port.

8. The apparatus of claim 1, wherein the sleeve establishes at least a partially serpentine path for the cement flowing from the region outside of the tubular member through the port.

9. The apparatus of claim 1, wherein the sleeve increases a coverage of the cement in the region outside of the tubular member.

10. A method usable with a subterranean well, comprising:

circulating a cement between a region outside of a downhole tabular member into a port of the tubular member; and using a sleeve outside of the port to alter a flow of the cement near the port to increase a coverage of the cement in the region.

11. The method of claim 10, wherein the sleeve extends the flow of the cement beyond the port.

12. The method of claim 10, wherein the port comprises a radial port.

13. The method of claim 10, wherein the sleeve, in response to the cement circulating through the port, causes the flow to extend into a region in which the flow would not enter in the absence of the sleeve.

14. The method of claim 10, wherein said region in which the flow would not enter in the absence of the sleeve comprises a region located above the port.

15. The method of claim 10, wherein the sleeve creates a radial barrier outside of the port in response to the cement circulating from the region outside of the tubular member through the port.

16. The method of claim 10, wherein the sleeve establishes at least a partially serpentine path for the cement flowing from the region outside of the tubular member through the port.

* * * * *